United States Patent [19]

Heim et al.

[11] 4,228,965

[45] Oct. 21, 1980

[54] ASSEMBLY FOR WINDING YARNS AND THE LIKE ON A BOBBIN

[75] Inventors: Richard Heim, Hürth; Peter Hermanns; Alfred Tschentscher, both of Cologne, all of Fed. Rep. of Germany

[73] Assignee: FMN Schuster GmbH & Co. KG, Hürth, Fed. Rep. of Germany

[21] Appl. No.: 43,854

[22] Filed: May 30, 1979

[30] Foreign Application Priority Data

Jun. 8, 1978 [DE] Fed. Rep. of Germany ..... 2825183

[51] Int. Cl.[3] ..... B65H 54/40; B65H 59/00

[52] U.S. Cl. ..... 242/45; 242/18 DD

[58] Field of Search ..... 242/45, 18 DD

[56] References Cited

U.S. PATENT DOCUMENTS

| | | | |
|---|---|---|---|
| 2,950,067 | 8/1960 | Keith | 242/45 X |
| 3,288,383 | 11/1966 | Muller | 242/45 |
| 4,069,985 | 1/1978 | Lohest et al. | 242/45 |

FOREIGN PATENT DOCUMENTS

| | | | |
|---|---|---|---|
| 86672 | 12/1971 | Fed. Rep. of Germany | 242/45 |
| 1195598 | 5/1959 | France | 242/45 |
| 926567 | 5/1963 | United Kingdom | 242/45 |
| 944552 | 12/1963 | United Kingdom | 242/45 |

*Primary Examiner*—Stanley N. Gilreath
*Attorney, Agent, or Firm*—Neil F. Markva

[57] ABSTRACT

The assembly for winding yarn on a thread package comprises electrically operated friction drive means and electrically operated axial drive means. The mandrel tube which carries the bobbin tube and the thread package is frictionally driven. The mandrel itself is axially driven by the electrically operated axial drive means. The friction drive and the axial drive are effective to operate in tandem. The friction drive comprises a synchronous motor. The axial drive includes a three-phase a.c. motor, a reluctance motor, or a d.c. motor.

5 Claims, 2 Drawing Figures

ASSEMBLY FOR WINDING YARNS AND THE LIKE ON A BOBBIN

FIELD OF THE INVENTION

This invention relates to an assembly for winding threads, especially synthetic yarns, on a bobbin or bobbin tube carried on a mandrel in which the thread winding is driven at the periphery by a friction or pressure roller and the mandrel itself is provided with an axial drive.

BACKGROUND OF THE INVENTION

It is necessary that the winding procedure for winding yarns or threads, especially synthetic threads, should be effected at a constant winding speed. Any alteration in this speed produces blemishes during the processing of the thread up to the finished product. Thus, it is usual to drive the thread package at the periphery thereof by a friction or pressure roller. The rotational speed of the motor remains constant and continues to be unrelated to the increasing diameter of the thread winding. When the shaft of the thread package is driven, complicated control systems are required to adapt the rotational speed of the shaft to the increasing diameter of the thread package to achieve the uniform peripheral speed of the package.

Difficulties frequently occur with the friction drive at high winding speeds such as 6000 to 7000 meters per minute and above. During this starting phase of such a winding procedure, the mandrel and the bobbin tube cannot be brought rapidly enough up to the required rotational speed. Slippages occur between the synchronous motor having an external rotor which rotates at constant speed and the bobbin tube located on the mandrel. The slippages can be so large that the bobbin tube is damaged during the start of the winding procedure. Frequently, the initial thread layers in the thread package are seriously damaged because of the lack of synchronism between the friction drive and the thread package.

The prior art has attempted to eliminate this disadvantageous slippage by changing the association between the friction drive and the axial drive of the mandrel. For example, it is known to use a gas turbine run with compressed air for effecting the axial drive of the mandrel. There must be a reduction in the moment to be brought into the axial drive in conformity with the decreasing angular velocity with increasing thread package. The supply of gas pressure must be controlled through a pressure control device operating in conjunction with the gas turbine. In one instance, decreasing support through the gas turbine is maintained until the thread package is completed. In another case, the axial drive is effected only for a certain predetermined period. Once the predetermined diameter of the thread package has been achieved, the axial drive is completely turned off. As long as the axial drive is in operation, however, the pressure of the compressed air for the gas turbine must be constantly reduced to achieve a gradual reduction of the axial driving torque.

The use of these prior art gas turbines is subject to considerable disadvantages. Considerable amounts of compressed air must be used resulting in many disadvantages such as considerable noise which to a greater or lesser degree is sirenlike. The double drive mechanism using a friction roller and a gas turbine for effecting the axial drive of the mandrel furthermore does not show satisfactory results.

SUMMARY OF THE INVENTION

The invention as described herein includes the combination of a friction roller drive and the use of an electrically operated drive means for effecting the axial drive of the mandral. This has been found to considerably reduce the energy expended for such an operation. Furthermore, the control between the moments to be apportioned of the drives is simplified. In a specific embodiment of the invention, the electrically operated axial drive means for the mandrel comprises a three-phase a.c. (alternating current) motor. The electrically operated friction drive means acting on the periphery of the thread package comprises a synchronous motor. Such an electrically operated friction drive means is known.

The three-phase a.c. motor has a short circuited rotor with constant moment and obtains such a characteristic curve that it is adaptable to a predetermined synchronism along with the friction drive means. The combination of the synchronous motor as a friction drive means and the three-phase a.c. motor as the axial drive means has been found to achieve advantageous results. The synchronous motor is rigid in the retention of the synchronism and takes over the task of keeping the speed synchronous in the capacity of the leading motor. On the other hand, the three-phase a.c. motor operating as a short circuited rotor adapts easily in synchronism to the friction drive means composed of the synchronous motor. Thus, the synchronous motor acts as a pacemaker while the three-phase a.c. motor in the capacity of axial drive means is pulled into step as regard to the frequency by the synchronous motor and follows the latter. The three-phase a.c. motor thereby takes over the task or rotating the thread package, while the synchronous motor serves merely to hold the frequency reliably.

The division of tasks between the two electric motors, namely, the friction drive means and the axial drive means during the winding procedure, makes it possible to use a reluctance motor as the pacemaker to maintain the desired frequency. In this embodiment, the reluctance motor simply carries out the duty of a pacemaker after being brought into step. At the same time, the three-phase a.c. motor depends wholly on the synchronous running of the reluctance motor through the intermediary of the revolving thread package and in doing so produces the required speed performance.

BRIEF DESCRIPTION OF DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
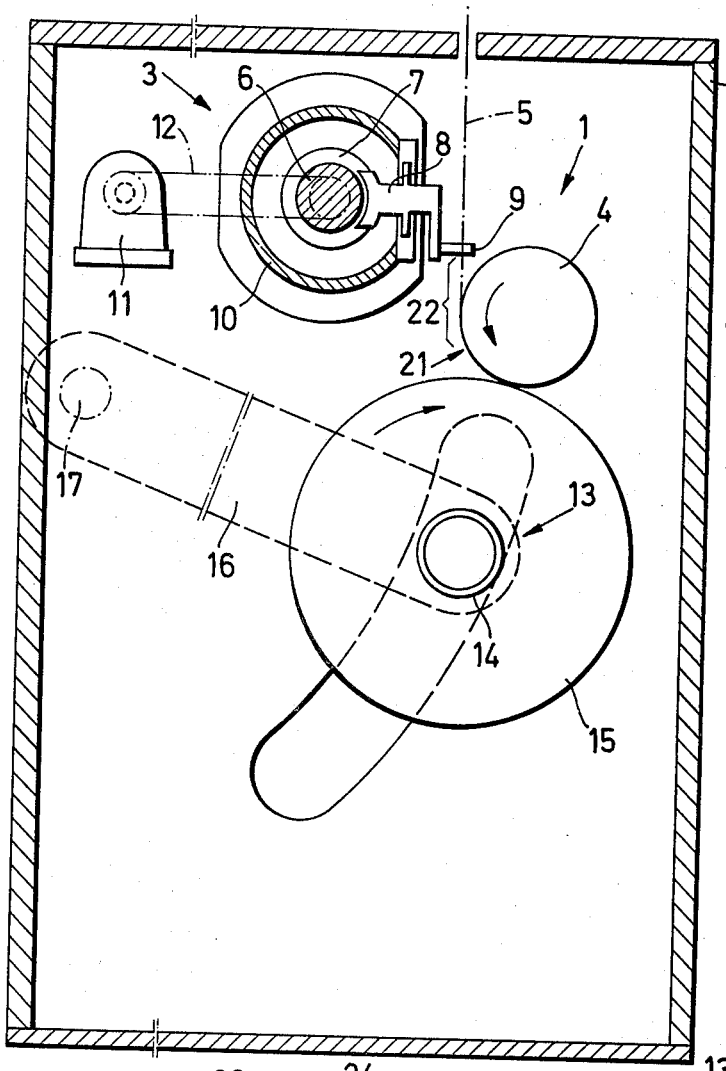
FIG. 1 is a front elevational view partly in section of a winder having a friction drive and made in accordance with this invention.
Figure 2:
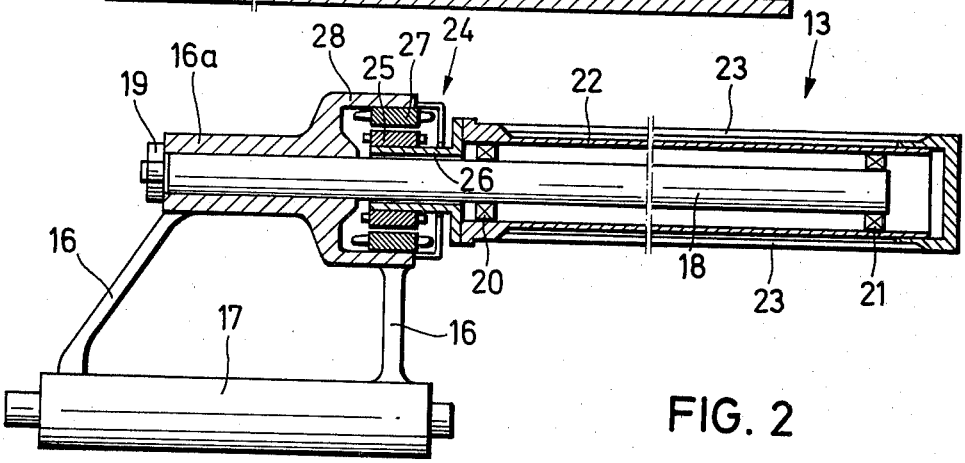
FIG. 2 is a longitudinal sectional view of the bobbin, mandrel and mandrel drive through an electric motor.

The winder, generally designated 1, makes thread packages of yarns or threads in housing 2 and includes a traversing device 3 and a friction or pressing roller 4. A thread guide 9 has a traveler 8 which engages the helical grooves 7 of a reversing thread roller 6. As roller 6 rotates, thread guide 9 moves along the length thereof and effects a to-and-fro movement to thread 5. Reversing thread roller 6 is pivoted in casing 10 and driven by motor 11 via belt drive 12.

Bobbin tube 14 is slipped on mandrel 13 which may be in the form of an expanding mandrel. Thread 5 is wound on bobbin tube 14 forming a thread package 15. Mandrel 13 includes swivel arm 16 which pivots about shaft 17 which is fixedly supported in housing 2. Biasing means (not shown) such as a jack operated by a pressure medium, acts on swivel arm 16 to keep thread package 15 pressed against pressure roller 4. This type of pressure applying or biasing mechanism is well known and by itself does not form a part of this invention. Mandrel 13 includes a stationary axle 18 fixedly supported in casing-like component 16*a* via screw coupling 19. A mandrel tube 22 is rotatably mounted on axle 18 via ball bearings 20 and 21. Movable bars 23 are disposed on mandrel tube 22 for exerting a gripping action on bobbin tube 14 which is slipped onto mandrel 13.

A synchronous motor is used to rotate friction roller 4 at a constant peripheral speed during rotation of thread package 15. Friction roller 4 may comprise a roller motor having an outside rotor. The outside rotor of the synchronous motor comprises a driving cylinder which bears against the perimeter of thread package 15. At a predetermined frequency, the synchronous motor strictly preserves a pre-set speed so that a predetermined peripheral speed is maintained while forming thread package 15.

An adaptable or variable speed electric motor 24 axially drives mandrel tube 22 for revolving thread package 15. The speed of motor 24 is regulated by a frequency converter. In this embodiment, electric motor 24 comprises a three-phase a.c. motor as a squirrel-cage rotor, which can adapt itself in synchronism to the synchronous motor as a friction drive through thread package 15 upon which the friction drive acts externally and the axial drive of the three-phase a.c. motor acts internally. Thus, the friction drive is the controlling element and the axial drive operates in tandem with the friction drive and adapts itself to the conditions conferred by the synchronous motor. That is, the three-phase a.c. motor being the axial drive follows possible fluctuations in synchronous motor as a result of acceleration or deceleration. In this way the production of the thread package 15 is conducted extremely gently.

Rotor 25 of three-phase a.c. motor 24 is directly connected with mandrel tube 22. A tube attachment 26 is rigidly connected to the end of mandrel tube 22 and carries rotor 25 of motor 24. Thus, special bearings for the three-phase a.c. motor 24 are unnecessary with the consequent elimination of an additional source of friction and additional dead weight. Stator 27 of motor 24 is correspondingly suspended in casing part 28 of swivel arm section 16*a*. Casing part 28 overlaps tube attachment 26 as shown.

As an alternative embodiment, a reluctance motor may also cooperate with the three-phase a.c. motor 24. The reluctance motor provides friction drive for thread package 15 and motor 24 provides axial drive for mandrel 13. The reluctance motor has advantageously allotted thereto the exclusive duty of serving as pacemaker for the desired synchronism. The axial drive of motor 24 produces the torque for thread package 15. This results in a substantial reduction in cost of the complete driving equipment. With the reluctance motor constituting only a pacemaker, it does not need to have a high maximum continuous rating. Such a reluctance motor may be a roller motor or have a flange-connected friction roller.

In operation, mandrel 13 is brought up to the required peripheral or rotational speed through the axial drive during the starting phase. A slight deviation from the peripheral speed of the friction drive, e.g., of the roller motor, is acceptable because the three phase a.c. motor 24, adaptable from the characteristic, is synchronized via thread package 15 through the synchronous motor operating as a pacemaker. Only very slight frictional forces occur between the friction motor and bobbin 14 or thread package 15 during the starting phase thereby resulting in a very gentle treatment of the bobbin tubes 14.

Although the axial motor has only a low performance capability, the time taken for mandrel 13 to run up to its operating speed is very short because axial motor 24 can apply high torque owing to its torque characteristic if it deviates very considerably in rotational speed from the rated speed. This operation is suitable for the most part for the running up to speed phase. The synchronous motor need not meet this efficiency in running up to speed with such a tandem drive, thereby signifying a large reduction in performance for the latter. This relates to both the synchronous motor and the frequency converter necessary therefor. The pull-out torque of the synchronous motor may be relatively small as it need no longer apply acceleration torques.

As stated, the axial drive need not be exactly adapted in rotational speed to the friction motor during the starting phase when mandrel 13 is running up to speed. However, synchronizing torques occur at the instant of contact in a negligibly small magnitude so that the bobbin tubes 14 and also the wound-on thread material are protected to the greatest possible extent. As the winding diameter of package 15 increases, the frequency of the converter determining the running of the axial motor 24 is reduced in accordance with the slowing down rotational speed. The voltage-frequency ratio of the converter remains constant. As a result, the power of axial motor 24 drops approximately linearly with the rotational speed while torque remains constant. Consequently, it follows that the synchronous motor must deliver constant power over the entire package diameter. Thus, the synchronous motor can be more advantageously dimensioned with respect to small pull-out torques resulting both in efficiency and lower costs.

When initially winding thread 5 onto mandrel 13 during the start of the winding procedure, any synchronous shock is avoided between the friction drive and the axial drive during the described tandem function of the two drives. The three phase a.c. motor 24 may operate only for starting up and building up of the package 15 to a suitable diameter and may then be disengaged. In this case, several mandrel drive motors may be controlled by one collective converter. Alternatively, the expanding mandrel is driven until the complete thread package 15 has been completed. Each axial motor 24 must then be served by a frequency converter regulated via potentiometers from the thread package diameter.

A hysteresis motor may also be used as a very economical friction drive means. The axial drive may be effected by a d.c. motor without commutator and with the associated control electronics in place of the three-phase a.c. motor 24.

As stated above, with the rotor of the three-phase a.c. motor 24 disposed on the mandrel tube 22, the need for an additional bearing for the axial drive is eliminated thereby reducing sources of friction. The tandem function of the tube drives is thereby accomplished more reliably with this particular configuration as discussed.

With respect to the use of the reluctance motor, a flanged-on roller may be used to bear on the periphery of thread package 15. In this way, the reluctance in a moderately priced construction may be formed adequately large while the friction roller may have a relatively small diameter.

The use of two electric motors in the tandem system described herein provides considerably reduction in the energy expended when compared to the prior art gas turbine drive for the axial drive. Frictional forces are substantially eliminated through the cooperation of the electric motors. Thus, the thread and thread package is very carefully treated during the winding procedures involving extremely high speeds of 6000 meters per minute and more. The characteristic of the three-phase a.c. motor through the characteristic curve imparted thereto is due to the axial drive being able to conform as pacemaker through the revolving thread package 15 to the synchronous motor in the capacity of friction drive to any possible deviating speed or slowing down. Therefore, the winding up of the yarn or thread to the thread package form takes place in a satisfactory manner from the start of the winding procedure to its finish. Thus, even with the first winding of the innermost layers of threads in the thread package, flaws which lead to the so-called specks or lustrous spatter and the like are completely eliminated while the thread is being worked up into a finished product.

With a coordination between the two electric motors in the driving of thread package 15 at a constant peripheral speed, the reluctance motor is required to guarantee the synchronous running. Thus, the reluctance motor does not need to be designed for a high outout particularly for the starting output used in the initial portion of the winding procedure. The reluctance motor does not have to be oversized like a synchronous motor which may not drop out of synchronism, particularly in the case of the surge load produced upon the starting of the mandrel operation. Both the friction drive and the axial drive must be in operation unitl thread package 15 is completed when a reluctance motor is used. A potentiometer operates through a controlled frequency converter for this operation. Thus, the production of an acceptable thread package is guaranteed from the start to the finished bobbin.

While the assembly for winding yarns and the like on a bobbin has been shown and described in detail, it is obvious that this invention is not to be considered as being limited to the exact form disclosed, and that changes in detail and construction may be made therein within the scope of the invention, without departing from the spirit thereof.

We claim:

1. An assembly for winding yarn on a thread package, especially synthetic threads, on to a bobbin or bobbin tube carried on a mandrel, said assembly comprising:

(a) the mandrel including a frame portion and a mandrel tube mounted to rotate on bearing means located on a stationary axle fixed to the frame portion, (b) said bearing means includes two bearings laterally spaced with respect to each other on said stationary axle to rotatably support said mandrel tube, (c) electrically operated friction drive means driving the mandrel tube which carries the bobbin tube and the thread package, and (d) electrically operated axial drive means for directly rotating the mandrel tube which includes a tube attachment at one end thereof, (e) said friction drive means and said axial drive means being effective to operate in tandem, (f) the axial drive means includes a three-phase a.c. motor having a stator and a rotor with the rotor rigidly disposed on the tube attachment, (g) said mandrel frame portion includes a casing part overlapping the tube attachment with the stator of the three-phase motor being disposed therein around said rotor.

2. An assembly as defined in claim 1 wherein the friction drive means includes a synchronous motor connected to frictionally drive said thread package.

3. An assembly as defined in claim 1 wherein the three-phase a.c. motor has a squirrel-cage rotor with a constant moment effective to provide a specified synchronism along with the friction drive means.

4. An assembly as defined in claim 1 wherein the friction drive means includes a reluctance motor connected to frictionally drive said thread package.

5. An assembly as defined in claim 1 wherein the friction drive means comprises a pacemaker for maintaining a constant rotational speed, and the axial drive means is effective to produce the torque for the thread package in adaptation to the synchronism of said friction and axial drive means.

* * * * *